United States Patent [19]

Longrod

[11] 4,395,149

[45] Jul. 26, 1983

[54] RIBBON DRIVE MECHANISM

[75] Inventor: Scott J. Longrod, Woodbury, Conn.

[73] Assignee: SCM Corporation, New York, N.Y.

[21] Appl. No.: 301,342

[22] Filed: Sep. 11, 1981

[51] Int. Cl.[3] ..... B41J 33/18; B41J 35/10

[52] U.S. Cl. ..... 400/215; 400/232; 400/236.1; 400/697.1

[58] Field of Search ..... 400/236.1, 697.1, 212, 400/214, 215, 232

[56] References Cited

U.S. PATENT DOCUMENTS 3,724,633 4/1973 Korb et al. ..... 400/214 X 3,997,046 12/1976 Wolowitz ..... 400/214 X

OTHER PUBLICATIONS

IBM Technical Disclosure Bulletin, vol. 19, No. 7, Dec. 1976, pp. 2393–2394.

IBM T. D. B., vol. 11, No. 12, May, 1969, pp. 1754–1755.

*Primary Examiner*—Edgar S. Burr

*Assistant Examiner*—Charles A. Pearson

*Attorney, Agent, or Firm*—Kenneth W. Greb; Ernest F. Weinberger

[57] ABSTRACT

A ribbon drive mechanism for a typewriter or similar machine in which the supply spool and a first ribbon guide are fixed with respect to the machine frame, and the take-up spool and a second ribbon guide are vertically moveable with respect to the machine frame. The ribbon is fed past the print point when the take-up spool and the second ribbon guide adjacent thereto are in their raised position. Means are also provided for feeding a constant increment of ribbon, regardless of the amount of ribbon on the take-up spool.

3 Claims, 2 Drawing Figures

RIBBON DRIVE MECHANISM

BACKGROUND OF THE INVENTION

A. Field of the Invention

This invention relates to typewriters, printers and like machines, and particularly to a ribbon drive mechanism for use in such machines.

B. Description of the Prior Art

IBM Technical Disclosure Bulletin, Vol. 19, No. 7, December, 1976 discloses an erase ribbon lift and advancing mechanism which includes a ratchet and pawl driving mechanism, vertically moveable error correction ribbon supply and take-up spools, vertically moveable ribbon guides, and means to achieve a constant ribbon feed increment regardless of the diameter of the ribbon on the take-up spool.

The vertically moveable ribbon guides in the IBM mechanism lift the error correction ribbon into position for error correction. When the error correction ribbon is lifted by two ribbon guides of the type which have openings through which the ribbon passes, it is possible for the ribbon to become caught and not feed or feed improperly in either or both of the moveable ribbon guides. The present invention reduces the possibility of the ribbon being so caught by providing mechanism whereby only one of the ribbon guides is vertically moveable. In addition, to prevent looseness of ribbon between the vertically moveable ribbon guide and the take-up spool when they are in the lowered position, means are provided for the take-up spool to be vertically moveable with the ribbon guide.

SUMMARY OF THE INVENTION

The present invention is concerned with a compact ribbon drive mechanism in which a supply spool and a first ribbon guide are fixed with respect to the typewriter frame, and a take-up spool and a second ribbon guide are vertically moveable with respect to the typewriter frame. The ribbon drive mechanism may, for example, be mounted on a moving carrier in a typewriter although the description of the ribbon drive system herein refers to an error correction drive system. The present invention is intended to also include ribbon drive systems in which the ribbon is a typing or printing ribbon. In the latter case, the ribbon drive system is initiated by a typing operation rather than an error correction operation. According to the present invention, upon initiation of an error correction operation, a vertically moveable spool bracket raises the take-up spool and a vertically moveable ribbon guide to a position whereby the vertically moveable ribbon guide raises the error correction ribbon to a position for correcting an error. A lifting arm which is pivoted and raised by the vertically moveable spool bracket raises a pawl that rotates a metering disc coupled to the take-up spool. Means are provided which raise the pawl to a greater distance than the spool bracket. In this manner, the take-up spool is rotated and ribbon is fed past the print point. Means are also provided, in response to an increase in the diameter of the ribbon on the take-up spool, to decrease the degree of rotation of the take-up spool. A constant amount of ribbon may thereby be fed regardless of the diameter of the ribbon on the take-up roller. Also, in accordance with the present invention, since only one ribbon guide, i.e., the ribbon guide located nearest the take-up spool, is raised during the error correction operation there is less likelihood of the ribbon becoming loose, than if both ribbon guides were raised.

BRIEF DESCRIPTION OF THE DRAWING

A preferred embodiment of the invention will be described in detail with reference to the accompanying drawing in which.

DESCRIPTION OF THE PREFERRED EMBODIMENT

Figure 1:
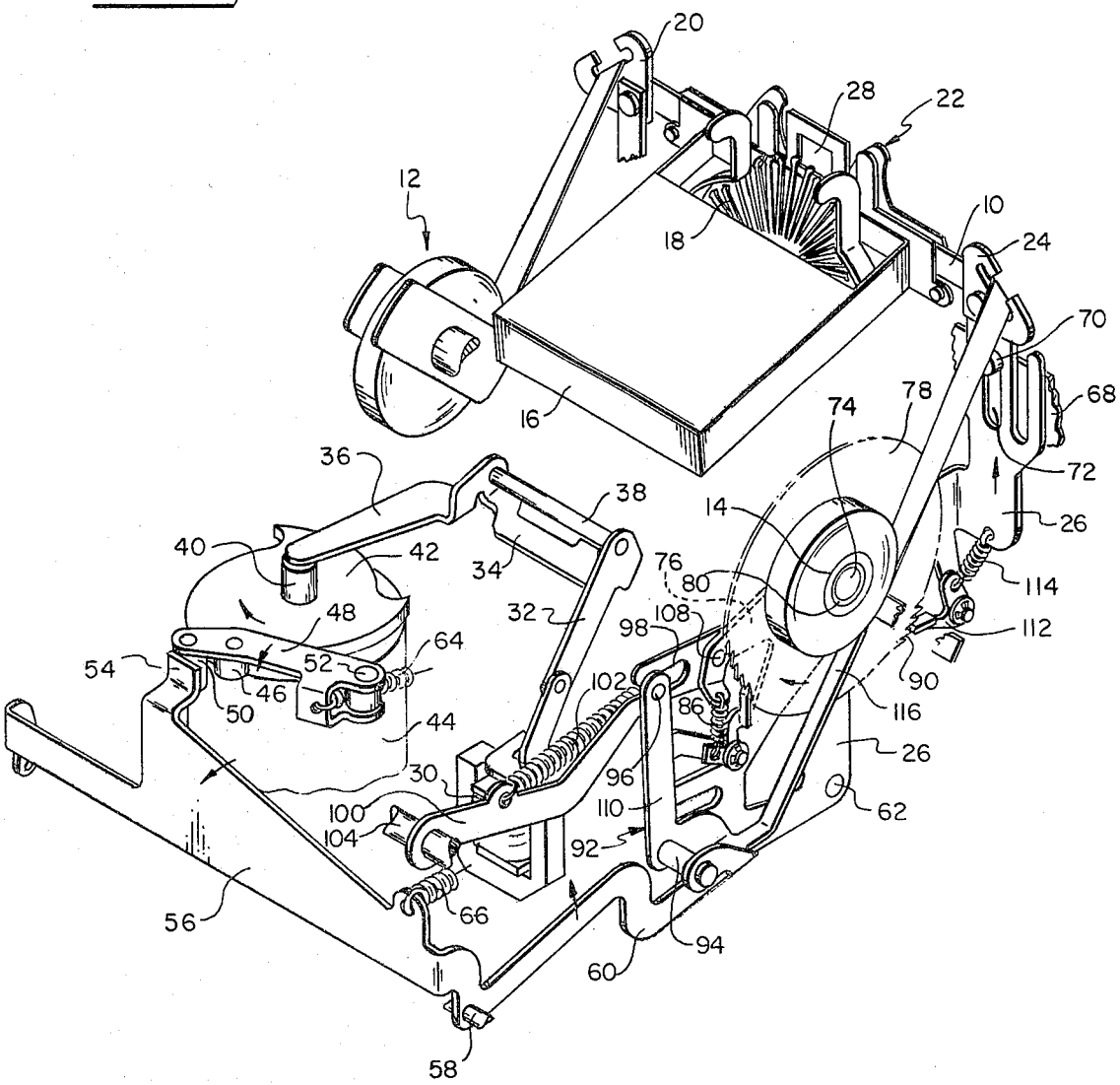
FIG. 1 is a perspective view of the ribbon feed system of the present invention.

With reference to FIG. 1 there is shown an error correction ribbon drive system of a type which may be used in typewriters or printers. Although the following discussion refers to typewriters, it is expected that the subject ribbon drive system may be used in printers and other similar machines as well. While the following discussion refers to error correction ribbons, as previously noted, the ribbon drive system may also be used for printing ribbons such as carbon and fabric ribbons. An error correction ribbon 10 extends between a fixed supply spool 12 and a vertically moveable take-up spool 14. The supply spool 12 and take-up spool 14 are shown as being vertically mounted to provide an open area between the spools to accomodate a print ribbon cartridge 16 and a removeable disc type print element 18. The ribbon 10 is threaded from the fixed supply spool 12 through a ribbon guide 20 which is fixed with respect to the typewriter frame. Thereafter, the ribbon 10 is threaded through a print point ribbon guide 22, a vertically moveable ribbon guide 24, and thereafter is wound on take-up spool 14. Ribbon guide 24 is mounted on vertically moveable spool bracket 26 which will be described more fully below. The typewriter print point 28 is located midway between ribbon guide 20 and ribbon guide 24.

Figure 2:
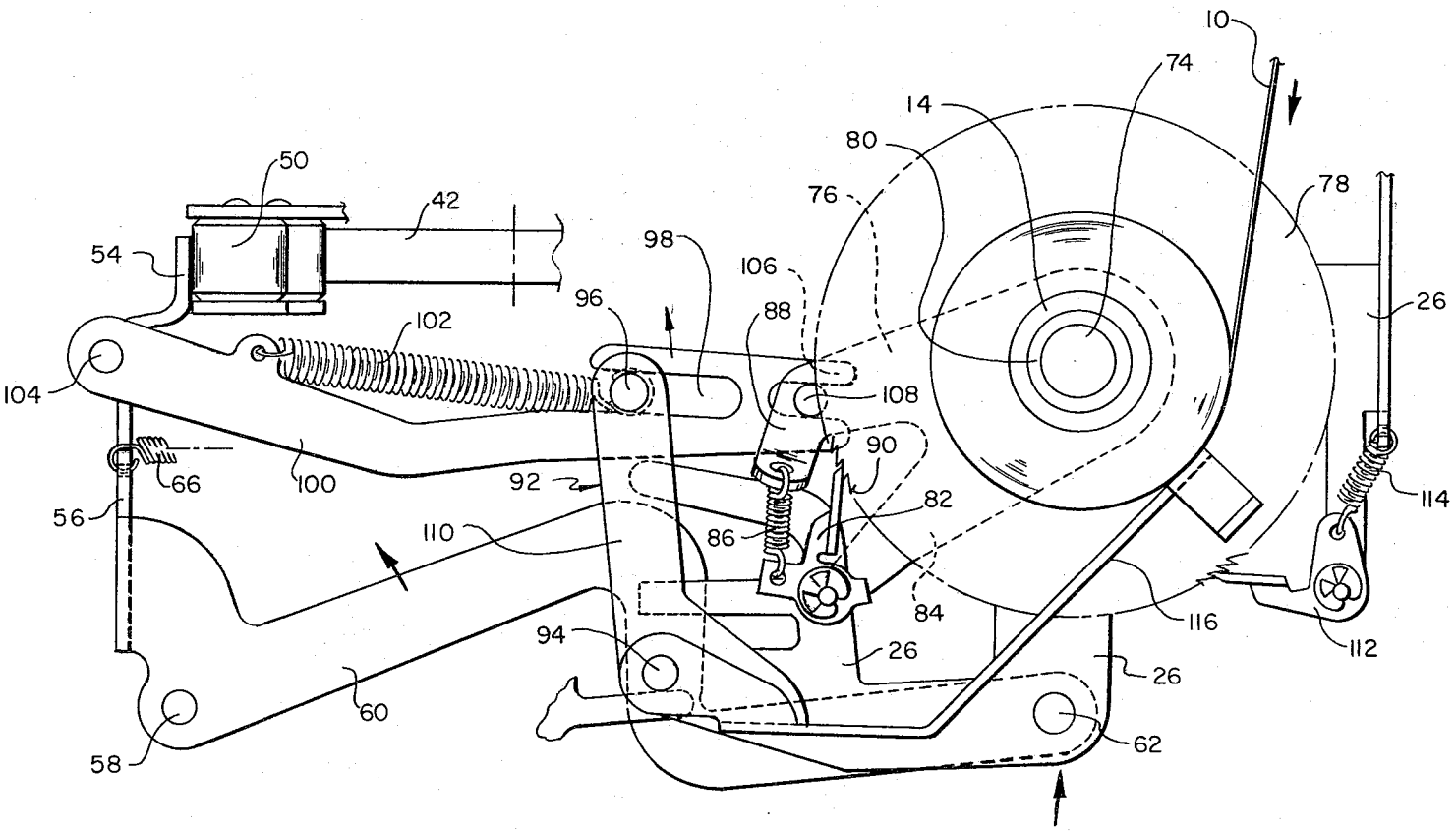
FIG. 2 is a right side elevational view of the ribbon feed system of the present invention.

When the typist wishes to correct an error, an error correction typewriter key at the typewriter keyboard (not shown) is depressed and appropriate electronic circuitry activates solenoid 30. The activitation of solenoid 30 causes linkage 32, 34 and thereby arm 36 of linkage 32, 34 to rotate counter-clockwise about fixed rod 38. Counter-clockwise rotation of arm 36 activates a clutch 40 which causes cam 42 to be coupled to motor 44 for rotation therewith. Rotation of the cam surface of cam 42 against roller 46 of follower arm 48 causes follower arm 48, and roller 50 of follower arm 48, to pivot about a fixed shaft 52 in the direction of the arrow. Movement of roller 50 also carried by follower arm 48 against finger 54 of bail 56 pivots bail 56 counter-clockwise about a rod 58. As seen most clearly in FIG. 2, bail 56 includes an arm 60 which is pivotably connected at 62 to spool bracket 26 so that when bail 56 is pivoted counter-clockwise about rod 58, arm 60 of bail 56 causes spool bracket 26 to move upward. After the cam 42 rotates one-third of a revolution, a spring 64 biases the arm 48 clockwise to position the roller 46 at its initial low position on the cam 42. After bail 56 is pivoted counter-clockwise about rod 58 causing upward movement of spool bracket 26 and an error correction operation occurs, spring 66 returns bail 56 to its rest position, upon partial rotation of cam 42.

As noted in FIG. 1, spool bracket 26 at its end proximate ribbon guide 24 is slidably mounted for vertical movement in a bracket 68 which is fixed with respect to the typewriter frame. A projection 70 on bracket 68 is located in groove 72 of spool bracket 26 and maintains the vertical alignment of spool bracket 26 with respect to bracket 68.

With reference again to FIG. 2, a hub 74 carrying a member 76 and a metering disc 78 is journalled for rotation on spool bracket 26. A metering disc hub 80 is integral with metering disc 78 and rotates therewith. Take-up spool 14 is mounted on metering disc hub 80 and therefore take-up spool 14 and metering disc 78 rotate together.

As metering disc 78 rotates clockwise, take-up spool 14 rotates clockwise and the ribbon 10 winds around the take-up spool 14. As the ribbon winds around take-up spool 14, new ribbon is caused to be fed from the supply spool 12.

A pawl 82 is pivotally mounted on one end of leg 84 of member 76. A spring 86 extending from the other leg 88 of member 76 biases pawl 82 into engagement with peripheral teeth 90 of metering disc 78. Pivotal motion of bail 56 raises spool bracket 26 and member 76. Upward motion of member 76 causes pawl 82 to move upward and engage and rotate metering disc 78 in a clockwise direction, which causes ribbon 10 to be wound around take-up spool 14.

A link 92 is pivotally mounted at one end on spool bracket 26 by a pin 94 for vertical movement therewith. Link 92 carries at its opposite end a stud 96 which rides in an open ended groove 98 of a lifting arm 100. A spring 102 has one end secured to lifting arm 100, and the other end secured to stud 96 of link 92 so that link 92 is urged to pivot in a counter-clockwise direction about pin 94. One end of lifting arm 100 is pivotable about rod 104, which is fixed with respect to the typewriter frame. The other end of lifting arm 100 includes a yoke 106 within which stud 108 of member 76 is located.

When arm 110 of link 92 is moved upwards by vertical movement of spool bracket 26, it causes lifting arm 100 to pivot counter-clockwise around rod 104. The lifting arm 100 causes the stud 108 to raise and pivot the member 76 clockwise about the hub 74 which, in turn, drives the pawl 82 relative to the vertical movement of the spool bracket 26. The pivotal movement of member 76 causes pawl 82 to incrementally rotate metering disc 78. The increase in distance that stud 108 raises above that which stud 96 would otherwise rise as a result of vertical movement of spool bracket 26, is due to the fact that the distance between rod 104 and the point at which yoke 106 of lifting arm 100 engages the stud 108 (i.e. the lever arm of lifting arm 100) is greater than the distance between rod 104 and stud 96 of arm 110. As previously noted, rotation of metering disc 78 causes rotation of take-up spool 14. The amount of upward movement pawl 82, and therefore the amount of rotation of take-up spool 14, depends on the amount of pivotal movement of lifting arm 100.

A pawl 112 is pivotally mounted on spool bracket 26 and is biased by a spring 114 extending from spool bracket 26 into engagement with teeth 90 of metering disc 78. The engagement of pawl 112 with teeth 90 prevents metering disc 78 (and thereby take-up spool 14) from rotating in a counter-clockwise direction, and unravelling of the ribbon 10 from take-up spool 14 is thereby prevented.

Upon restoration of bail 56 to its rest position by spring 66 after completion of an error correction operation, spool bracket 26 is lowered by arm 60 and link 92, lifting arm 100 and pawl 82 is thereby caused to be lowered. The pawl 82 is pivoted counter-clockwise about the hub 74 by the lowering of lifting arm 100. Since the pawl 112 prevents the metering disc 78 from rotating counter-clockwise, the pawl 82 ratchets over the teeth 90 to its lowered position. In this manner, pawl 82 is brought into engagement with teeth 90 of metering disc 78 for a subsequent error correction operation.

With the ribbon guide 20 fixed relative to the typewriter frame and with the ribbon guide 24 movable relative to the frame, the ribbon 10 raises and lowers within the print point ribbon guide 22 to avoid improper ribbon feeding. The fixed ribbon guide 20 retains a portion of the ribbon 10 adjacent the ribbon guide 20 within the print point ribbon guide 22 at all times. This ribbon portion acts as a leader for the remaining portion of the ribbon 10 which extends through the print point ribbon guide 22 and is raised and lowered within the print point ribbon guide 22.

According to the ribbon feed system as described to this point, if the metering disc 78 is rotated the same distance when the diameter of ribbon 10 on take-up spool 14 is large, as it is when the diameter of ribbon 10 on take-up spool 14 is small, more ribbon will be fed when the ribbon is of larger diameter. It is, however, desirable to feed a constant amount of ribbon 10 past the print point regardless of the amount of ribbon on the take-up spool 14. The means for feeding a constant amount of ribbon 10 past the print point include a sensing arm 116 which integrally extends from link 92. The spring 102 biases sensing arm 116 against the roll of ribbon 10 on take-up spool 14. As the roll of ribbon 10 on take-up spool 14 increases in diameter, sensing arm 116 and thereby link 92 rotate clockwise. As link 92 rotates clockwise, stud 96 of link 92 rides into groove 98 of lifting arm 100.

The amount of pivotal movement of lifting arm 100, and therefore the amount of rotation of take-up spool 14, depends on the distance between stud 96 of link 92, and stud 108 of member 76. The smaller the distance between the center of stud 96 of link 92, and the center of stud 108 of member 76, the less is the upward motion of stud 108 and pawl 82. Regardless of the distance between the stud 96 and stud 108, the pawl 82 always travels upwardly a distance greater than the periphery of metering disc 78 so that the ribbon 10 is always advanced. Therefore, as the roll of ribbon 10 on take-up spool 14 increases in diameter, and, as previously mentioned, stud 96 of link 92 rides into groove 98 of lifting arm 100 (thereby lessening the distance between the center of stud 96 of link 92, and the center of stud 108 of member 76) the amount of pivotal movement of the member 76 and pawl 82 and the amount of rotation of take-up spool 14 is lessened. In short, as the roll of ribbon 10 on take-up spool 14 increases in diameter, the amount of rotation of take-up spool 14 is lessened. In this manner, a constant amount of ribbon may be fed regardless of the diameter of the ribbon 10 on the take-up spool 14.

The invention and its attendant advantages will be understood from the foregoing description, and it will be apparent that various changes may be made in the form, construction and arrangements of the parts without departing from the spirit and scope of the invention, the form hereinbefore described being merely a preferred embodiment thereof.

What is claimed is:

1. A system for feeding a ribbon in typewriters and similar machines having a frame and a print point comprising:

a supply spool fixed with respect to the frame carrying a supply of ribbon;

a ribbon guide fixed with respect to the frame for guiding the ribbon from the supply spool towards the print point;

a bracket vertically moveable relative to the frame;

a take-up spool mounted on the bracket for vertical movement therewith and for receiving the ribbon from the supply spool;

a ribbon guide mounted on the bracket for vertical movement therewith for guiding the ribbon from the fixed ribbon guide toward the take-up spool;

means for raising the bracket for raising the ribbon to the print point;

means for incrementally winding the ribbon on the take-up spool for feeding the ribbon relative to the print point including;

a metering disc (78) mounted on the bracket (26) for vertical movement therewith for rotating the take-up spool (14), a feed pawl (82) mounted for movement with the bracket and engaging the metering disc, a shaft (104) mounted on the frame, a lifting arm (100) pivotably mounted directly on the shaft, a first pin (108) for coupling the feed pawl to the lifting arm and located a predetermined distance from the shaft, and a second pin (96) for coupling the bracket to the lifting arm for moving the lifting arm in response to the vertical movement of the bracket, the second pin located a distance from the shaft less than the predetermined distance of the first pin from the shaft causing the lifting arm to move the first pin a greater amount than the movement of the second pin for moving the feed pawl relative to the bracket to advance the metering disc for feeding the ribbon relative to the print point.

2. A system for feeding a ribbon as defined in claim 1 wherein the ribbon feeding means includes a member (76) supported on the bracket for pivotal movement relative to the metering disc, the feed pawl mounted on the member for movement therewith, the first pin mounted on the member for moving the member in response to movement of the lifting arm to cause the feed pawl to advance the metering disc.

3. A system for feeding a ribbon as defined in claim 1 further comprises;

a link (110) pivotably mounted on the bracket for vertical movement therewith, the second pin mounted on the link, and a sensing arm (116) formed from the link and biased against the other convolution of ribbon on the take-up spool for varying the location of the second pin relative to the first pin for feeding a constant amount of ribbon past the print point as the ribbon on the take-up spool increases in diameter.

* * * * *